US008887819B2

(12) United States Patent
Lee

(10) Patent No.: US 8,887,819 B2
(45) Date of Patent: Nov. 18, 2014

(54) SPRINKLER WITH AN INTEGRATED VALVE, AND FIRE-EXTINGUISHING SYSTEM USING SAME

(76) Inventor: Sang-Sun Lee, Seoul (KR)

( * ) Notice: Subject to any disclaimer, the term of this patent is extended or adjusted under 35 U.S.C. 154(b) by 730 days.

(21) Appl. No.: 13/140,651

(22) PCT Filed: Dec. 24, 2009

(86) PCT No.: PCT/KR2009/007782

§ 371 (c)(1),
(2), (4) Date: Jun. 17, 2011

(87) PCT Pub. No.: WO2010/077019

PCT Pub. Date: Jul. 8, 2010

(65) Prior Publication Data

US 2011/0247837 A1 Oct. 13, 2011

(30) Foreign Application Priority Data

Dec. 31, 2008 (KR) ..... 10-2008-0137836
Mar. 5, 2009 (KR) ..... 10-2009-0018855
Apr. 22, 2009 (KR) ..... 10-2009-0035192

(51) Int. Cl.
*A62C 3/07* (2006.01)
*A62C 3/08* (2006.01)

(Continued)

(52) U.S. Cl.
CPC ..... *A62C 35/58* (2013.01); *A62C 35/68* (2013.01); *A62C 37/36* (2013.01); *A62C 3/07*

(Continued)

(58) Field of Classification Search
USPC ..... 169/43, 46, 47, 56, 60, 61, 5, 6, 7, 16, 169/17, 23
See application file for complete search history.

(56) References Cited

U.S. PATENT DOCUMENTS 4,609,048 A * 9/1986 Yasaki et al. ..... 169/61
5,099,389 A * 3/1992 Ciboldi ..... 361/612

(Continued)

FOREIGN PATENT DOCUMENTS

JP 01-223978 9/1989
KR 10-2004-0099979 12/2004

(Continued)

OTHER PUBLICATIONS

International Search Report—PCT/KR2009/007782 dated Aug. 13, 2010.

*Primary Examiner* — Justin Jonaitis
(74) *Attorney, Agent, or Firm* — Cantor Colburn LLP

(57) ABSTRACT

The present invention relates to a sprinkler with an integrated valve, and to a fire-extinguishing system using same. Conventional sprinklers are too sensitive to the outbreak of a fire, and operate even if no fire has broken out, which would lead to a large amount of damage. For this reason, conventional sprinklers are often prevented from being operated in advance. In addition, sprinklers do not operate even upon the outbreak of a fire when the sensitivities thereof are lowered, rendering the sprinklers useless. The present invention aims to solve the abovementioned problems, and is configured such that a manager in a building checks whether or not a fire has broken out and if so sends an extinguishing signal, and wherein in the event a sensor for operating a sprinkler senses the outbreak of a fire, only the relevant sprinkler operates by means of a valve mounted thereon, thereby operating sprinklers only when a fire has actually broken out, and enabling a central control office, a fire station, or the like to verify the outbreak of a fire in each household at all times. Further the present invention can be applied to public transportation facilities such that water-spraying is carried out after an engine room or a control board in charge of the safety of the passenger cars and outside of the latter verifies the outbreak of a fire, thus still taking advantage of a high-sensitivity of sensor. As the present invention sprinklers water only in the event of an actual fire outbreak, erroneous operation can be prevented, and water can be sprinkled only in the required area, thereby extinguishing the fire in the early state of a fire outbreak.

8 Claims, 12 Drawing Sheets

(51) Int. Cl.

| | |
|---|---|
| ***A62C 3/10*** | (2006.01) |
| ***A62C 35/58*** | (2006.01) |
| ***A62C 35/68*** | (2006.01) |
| ***A62C 37/36*** | (2006.01) |

(52) U.S. Cl.

CPC .. (2013.01); *A62C 3/08* (2013.01); *A62C 3/10* (2013.01)

USPC ..... 169/7; 169/16; 169/23; 169/61

(56) References Cited

U.S. PATENT DOCUMENTS

| | | | | |
|---|---|---|---|---|
| 5,128,269 | A * | 7/1992 | Oitate et al. | 436/126 |
| 2002/0053440 | A1 * | 5/2002 | Gil | 169/37 |
| 2006/0063523 | A1 * | 3/2006 | McFarland | 455/423 |

FOREIGN PATENT DOCUMENTS

| | | |
|---|---|---|
| KR | 10-2005-0001550 | 1/2005 |
| KR | 20-0385989 | 5/2005 |

* cited by examiner

SPRINKLER WITH AN INTEGRATED VALVE, AND FIRE-EXTINGUISHING SYSTEM USING SAME

TECHNICAL FIELD

The present invention relates to a valve united sprinkler and an early fire extinguishing system using the same.

BACKGROUND ART

According to high industrial development, there are fire hazards at places such as general high-storied buildings and factories, and other special buildings where a number of persons are resident or work. Since such fire hazards are increasing and human casualties or injuries and property damages are huge, sprinklers are installed at places where a fire may break out in order to inject water into the places where a fire broke out more rapidly to thus extinguish the fire and thereby prevent the life and property from disaster in advance. In general, sprinklers are fire extinguishing facilities that can be recognized as the most excellent extinguishing equipment, in which sprinkler heads that are installed on the ceilings or walls of an object to be fire extinguished automatically detect whether or not a fire broke out, and then thermal detectors are dismantled to then break away from the sprinkler heads. Accordingly, pressurized water or compressed air is discharged from a water or air pipe, to thus automatically activate alarm valves and water pressurizing and supplying units and thereby discharge water with a certain pressure, and automatically extinguish the fire.

However, since these sprinklers are activated in a manner that a fire is detected by a single signal, malfunction may occur frequently. Further, once sprinklers are operated, the after-measures expenses should be paid highly. Thus, the more frequent malfunctions, the higher after-measures expenses. Accordingly, in many cases, sprinklers may be fabricated so that they do not operate.

However, if an accident happens in the case that sprinklers are set so that they do not operate, tremendous damages may be caused.

In addition, public transportation vehicles have no fire extinguishing facilities other than fire extinguishers that are currently displayed therein. That is, sprinklers are not still equipped in the public transportation vehicles. The reason why the sprinklers are not still properly equipped in the public transportation vehicles is because there is not only a big risk due to a malfunction of the sprinklers in the case that the sprinklers are equipped in the public transportation vehicles, but also an insufficient counter measurement to the malfunction of the sensitive sprinklers.

DISCLOSURE

Technical Problem

To solve the above problems or defects, it is an object of the present invention to provide a valve united sprinkler and an early fire extinguishing system using the same, which solves a defective of a conventional sprinkler that causes a frequent malfunction due to the fact that the sprinkler is operated by a single signal, and which automatically detects a fire at a fire place, to thereby generate an alarm for building officials in order to immediately inform them of the occurrence of the fire, and to thus quickly deal with the fire in order to extinguish the fire at an early stage.

In addition, it is another object of the present invention to provide a valve united sprinkler and an early fire extinguishing system using the same, which solves a defective of a conventional sprinkler that causes a frequent malfunction due to the fact that the sprinkler is operated by a single signal, to thus be used for public transportation vehicles such as subways, trains, aircraft, ships, coaches, or buses.

Technical Solution

To accomplish the above and other objects of the present invention, there is provided a valve united sprinkler comprising:

an open sprinkler head that is connected to a fire extinguishing solvent storage to sprinkle the solvent;

a sprinkler valve that is located between the solvent storage and the sprinkler head to open up the sprinkler head;

a sprinkler sensor that is located near the sprinkler head to detect whether or not a fire broke out; and a sprinkler controller that makes the sprinkler valve operate, wherein the sprinkler controller comprises:

one or more external detector signal pins that are connected to one or more external detectors, respectively;

a fire alarm signal output pin through which a fire alarm signal is output in which the fire alarm signal is generated by one or more fire detection signals generated from the one or more detectors;

an incoming fire extinguishing signal input pin through which an incoming fire extinguishing signal is input in which the fire extinguishing signal is generated after the fire has been recognized by the fire detection signal that has been output through the output pin; and a sprinkler sensor input pin through which an operation resultant signal of the sprinkler sensor is input in which the sprinkler sensor has been attached on the sprinkler.

Preferably but not necessarily, the one or more fire detection signals generated from the one or more detectors are OR-operated to thus output the fire alarm signal in the case that the one or more detectors have been operated, and an OR-operation value of the one or more fire detection signals generated from the one or more detectors and an OR-operation value of the fire extinguishing signal and an input value of the sprinkler sensor are AND-operated to thus activate the sprinkler valve.

Preferably but not necessarily, the OR-operation value of the one or more fire detection signals generated from the one or more detectors and an AND-operation value of the fire extinguishing signal and the input value of the sprinkler sensor are OR-operated.

Preferably but not necessarily, the OR-operation value of the one or more fire detection signals generated from the one or more detectors and the input value of the sprinkler sensor are OR-operated to become an output value for generating the fire alarm signal.

Preferably but not necessarily, the input value of a finally operated AND-operation value comprises a test signal in which the test signal is always NOT-operated to then be input, with a result that the finally operated AND-operation value becomes fault (F) to make the valve not activated.

According to another aspect of the present invention, there is also provided an early fire extinguishing system using a valve united sprinkler, the early fire extinguishing system comprising:

one or more external detectors that detect whether or not a fire occurs;

one or more sprinklers wherein the sprinkler comprises: one or more external detector signal pins that are connected to one or more external detectors, respectively; a fire alarm signal output pin through which a fire alarm signal is output in which the fire alarm signal is generated by one or more fire detection signals generated from the one or more detectors; an incoming fire extinguishing signal input pin through which an incoming fire extinguishing signal is input in which the fire extinguishing signal is generated after the fire has been recognized by the fire alarm signal that has been output through the output pin; and a sprinkler sensor input pin through which an operation of the sprinkler sensor is input in which the sprinkler sensor has been attached on the sprinkler;

a signal distributor (and manipulation panel) that receives the fire detection signals detected from the one or more external detectors and distributes the fire detection signals, and transmits the fire detection signals to at least one of an indoor control panel and an outdoor control panel; and a control panel that receives the one or more fire detection signals from the signal distributor (and manipulation panel) and comprises: a controller; and an anti-freezing intermediate valve and a ventilation fan stop signal input unit both of which are activated by the fire extinguishing signal, wherein the controller comprises: a fire alarm unit that alarms the occurrence of the fire as sound; a display that displays the location of the fire; and a fire extinguishing signal input unit that requests for extinguishing of the fire.

Preferably but not necessarily, the signal distributor (and manipulation panel) transmits a signal that activates an indoor gas circuit breaker when the one or more fire detection signals have been input.

Preferably but not necessarily, the early fire extinguishing system further comprises an emergency telephone network that works even in the case of the occurrence of the fire to manage the fire situation in which the emergency telephone network works to contact both a house where the fire broke out and a senior management agency even at the fire emergency situation.

According to still another aspect of the present invention, there is also provided an early fire extinguishing system using a valve united sprinkler for use in public transportation facilities, the early fire extinguishing system comprising:

one or more external detectors that detect whether or not a fire occurs;

one or more sprinklers wherein the sprinkler comprises: one or more external detector signal pins that are connected to one or more external detectors, respectively; a fire buzzer input pin with which a passenger presses to report a fire in a room; a fire alarm signal output pin through which a fire alarm signal is output in which the fire alarm signal is generated by one or more fire detection signals generated from the one or more detectors; and an incoming fire extinguishing signal input pin through which an incoming fire extinguishing signal is input in which the fire extinguishing signal is generated after the fire has been recognized by the fire alarm signal that has been output through the output pin; and a control panel that receives the one or more fire detection signals from the one or more detectors of the sprinkler and the fire buzzer signal pressed by the passenger and comprises: a fire alarm unit that alarms the occurrence of the fire as sound; a display that displays the location of the fire; and a fire extinguishing signal input unit that requests for extinguishing of the fire.

Preferably but not necessarily, the early fire extinguishing system further comprises an emergency telephone network to manage the fire situation in which the emergency telephone network works to contact all of a passenger room where the fire broke out, and an engine room and a senior management agency even at the fire emergency situation.

Preferably but not necessarily, signals of the one or more external detector signal pins that are generated by the one or more external detector signals and a signal of the fire buzzer input pin are OR-operated to thus output the fire alarm signal (B) in the case that the one or more signals of the one or more external detector signal pins and the fire buzzer input pin are input thereto.

Preferably but not necessarily, the fire alarm signal is transmitted to a control panel or an engine room that is positioned outside of a passenger car, in which the control panel makes a fire bell ring in the passenger car and controls a state of the passenger car, to thereby notify passengers that the fire alarm rang in the passenger car.

Preferably but not necessarily, the early fire extinguishing system comprises any one or both of an emergency call unit with the corresponding passenger car and a video detection unit, in which the control panel confirms if a fire broke out in the passenger car to then generate the fire extinguishing signal (F).

Preferably but not necessarily, a neighboring sprinkler can share the fire detection signal of the corresponding detector.

Preferably but not necessarily, only one valve that opens or closes the sprinkler is provided in one passenger car, in which all the sprinklers are activated at a time when the valve is opened, or a position of the valve and the number of the valves is controlled as necessary to control the fire extinguishing spray range.

Advantageous Effects

Therefore, a valve united sprinkler and an early fire extinguishing system according to the present invention provides an effect that prevents malfunction of the sprinkler and enables a fire to be early extinguished.

BEST MODE

Figure 1:
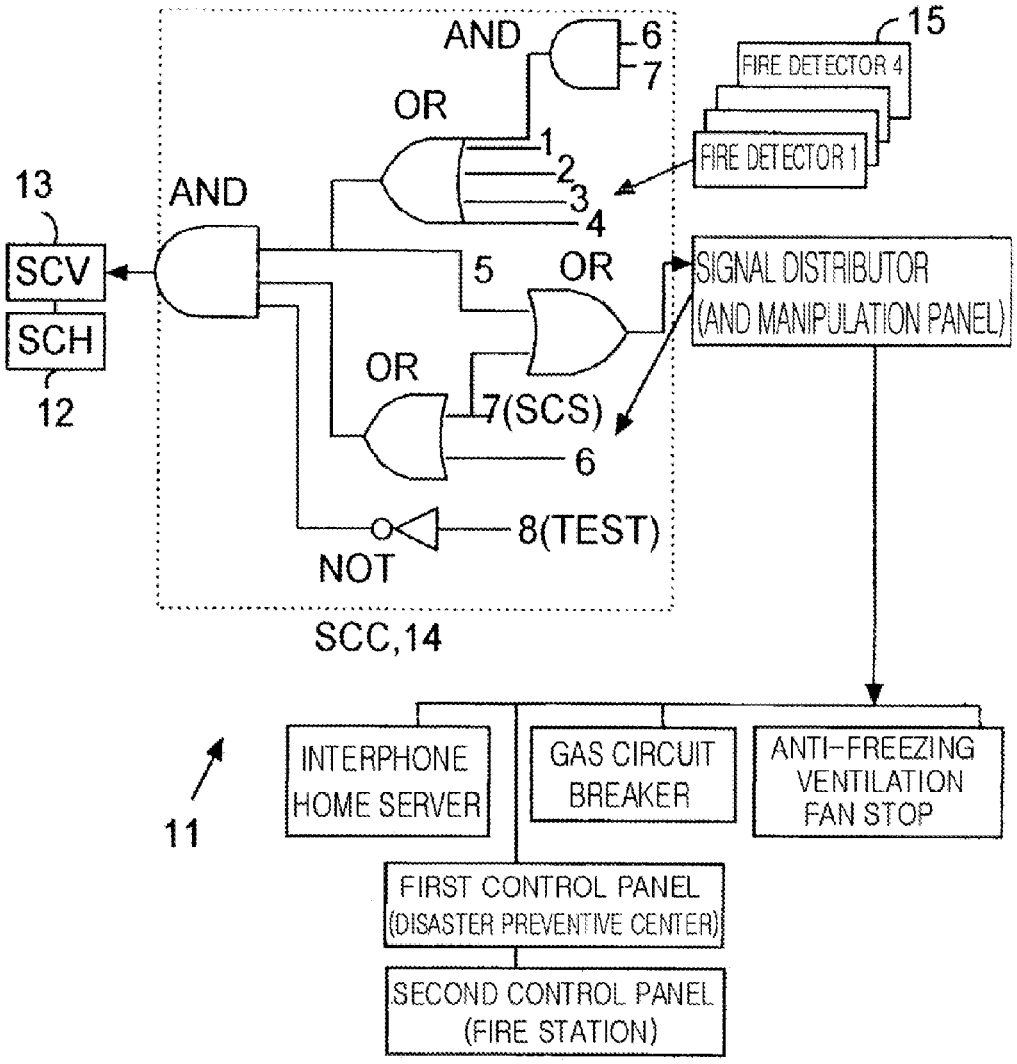
FIG. 1 is a block diagram conceptually showing an early fire extinguishing system employing a valve united sprinkler according to an embodiment of the present invention.

The above and/or other objects and/or advantages of the present invention will become more apparent by the following description. Hereinbelow, a valve united sprinkler and an early fire extinguishing system according to the present invention will be described in detail with reference to the accompanying drawings. FIG. 1 shows a configuration of a system according to the present invention, that is, a configuration of a valve united sprinkler (VSC), 11 according to the present invention, and a signal distributor (and manipulation panel). The valve united sprinkler includes a sprinkler head (SCH) 12, a sprinkler valve (SCV) 13, and a sprinkler controller (SCC) 14. The sprinkler valve employs an electronic valve and the sprinkler head is an open type. Thus, when the valve is opened by a control circuit, water can be immediately sprayed.

The sprinkler controller 14 receives signals from one or more indoor fire detectors 15. In the case that the fire detection signal is input to the sprinkler controller (SCC) 14 from at least one fire detector 15, the sprinkler controller (SCC) 14 uses the fire detection signal as a sprinkler operating signal and notifies an external signal distributor (and manipulation panel) 15 that a fire has been detected by the fire detector 15. In the case that the fire detection signal is input to the signal distributor (and manipulation panel) 15, a gas circuit breaker that blocks gas is made to immediately operate. In addition, the signal distributor (and manipulation panel) 15 transmits the fire detection signal to an external control panel and an internal control panel (such as a manipulation panel, an interphone, and a home server) again. The external control panel monitors a fire at a particular premise such as a fire station and an apartment complex, and the internal control panel is located at a site where the fire detection signal has been detected. The fire detection signal is transmitted to both the external control panel and the internal control panel, to thereby make a fire alarm signal ringing.

When the alarm signal rings, a person having received the alarm signal on-site checks if a fire has occurred. If he or she has checked that the fire has occurred, he or she presses a fire extinguishing button. Even if the fire extinguishing button is pressed at several places or a single place where the external control panel and the internal control panel are provided, a fire extinguishing signal that has been generated by pressing the fire extinguishing button becomes valid. The fire extinguishing signal is also transmitted as an input signal of the sprinkler controller (SCC) 14. Then, the sprinkler controller (SCC) 14 receives a signal from the sprinkler sensor (SCS) as well as the fire detection signal and the fire extinguishing signal, and performs an AND-operation of the received signals, to then make the sprinkler valve (SCV) 13 activated to be open to thus start to spray a solvent to the fire place through the sprinkler head (SCH) 12.

Assuming that a fire has occurred only in a certain room of a certain house, a spraying operation is performed only at a room where a fire has actually occurred, to thereby prevent spraying from being performed at the whole house by such an action of the sprinkler valve.

The sprinkler controller (SCC) 14 can control a number of valves (SCV) 13. A number of the valves are connected with a number of valve heads (SCH) 12, respectively. Thus, if a number of the valves are combined with a number of valve heads (SCH) 12, respectively, a variety of extinguishing solvents such as water sources and gas can be used in parallel.

The valve united sprinkler used in the present invention may be used for various kinds of extinguishing equipment such as drenchers, water spray extinguishers, and carbon dioxide or halogen powder spray extinguishers. An extinguishing solvent is determined by the extinguishing equipment. The sprinkler valves and the sprinkler controllers that are used in the present invention are used for the above-described extinguishing equipment, so as to respond to even a fire of any kind.

In FIG. 1, four input signals are set so as to be input from four fire detectors, but the number of the input signals input from the fire detectors may be adjusted as needed. Further, the kind of detectors to be used may be diverse. In FIG. 1, an eighth pin is a test pin. The test pin is used for testing whether or not the detectors function well. A test button of a signal distributor (and manipulation panel) is pressed to input a test signal into the eighth pin and then it is confirmed whether or not the detectors, the sprinkler sensors, and the extinguishing equipment are activated well.

Figure 2:
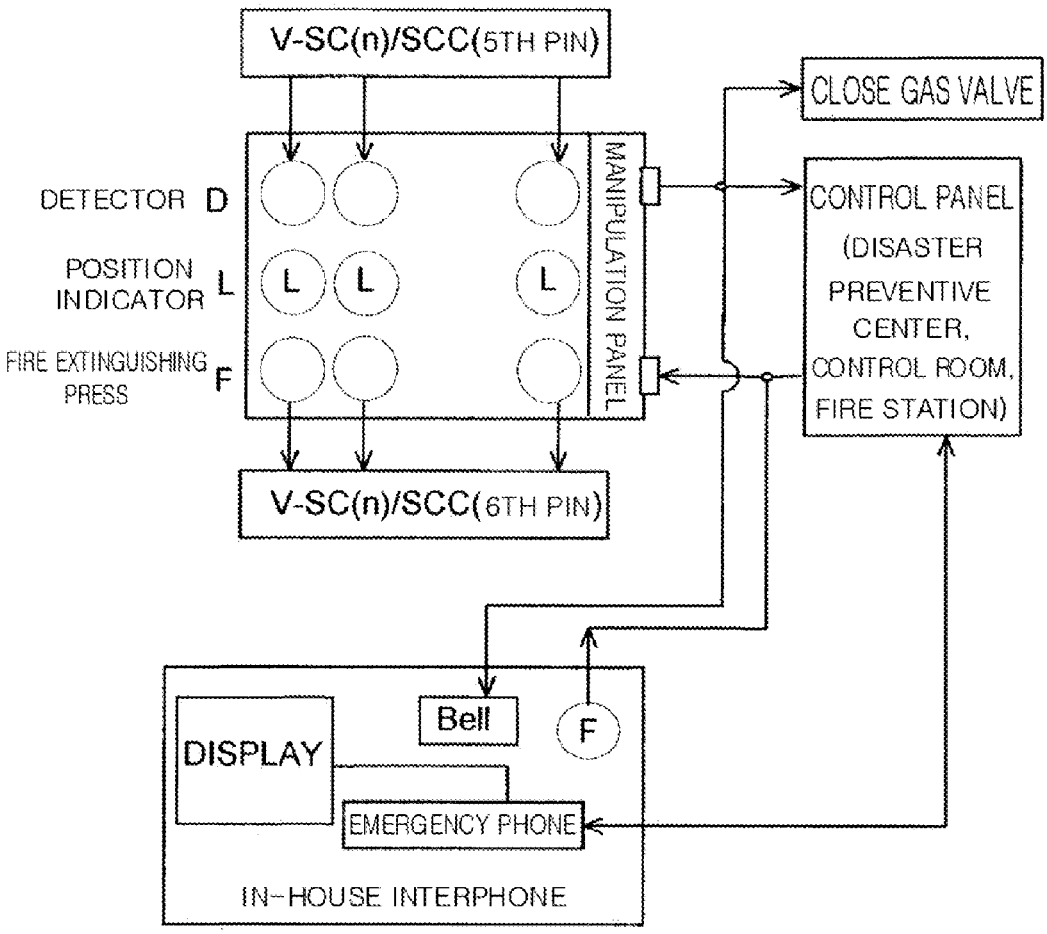
FIG. 2 is a block diagram showing a signal distributor (and manipulation panel) that is used in the present invention.

FIG. 2 is a block diagram showing a signal distributor (and manipulation panel) that is used in the present invention, and shows transmission of signals between the signal distributor (and manipulation panel) and an interphone. In the case that several sprinklers are used, the signal distributor receives an incoming signal from each sprinkler by operations of detectors and indicates if a fire detection signal is detected from a certain place. If the fire detection signal is input to the signal distributor (and manipulation panel), a gas valve is closed, to then send a signal to an external control panel such as a disaster preventive center and an apartment administration center, and a signal to an internal control panel such as an interphone, to thus make an alarm signal ring. If the external and internal control panels have received the alarm signal, corresponding house lamp is lit on a display in the disaster preventive center and the apartment administration center. Then, the corresponding house lamp is depressed to select the corresponding house. Thereafter, it is checked whether or not a fire has occurred at the corresponding house through an emergency call such as the interphone or a monitor. Then, if the fire has occurred at the corresponding house, the fire extinguishing button is clicked to thus generate a fire extinguishing signal. In this case, a person who confirms that the fire has occurred indoor can also click the fire extinguishing button to thus generate a fire extinguishing signal. Accordingly, in the case that the fire extinguishing signal has been input from any one place outdoor or indoor, the signal distributor (and manipulation panel) transmits the fire extinguishing signal as an input signal for the sprinkler controller.

Figure 3:
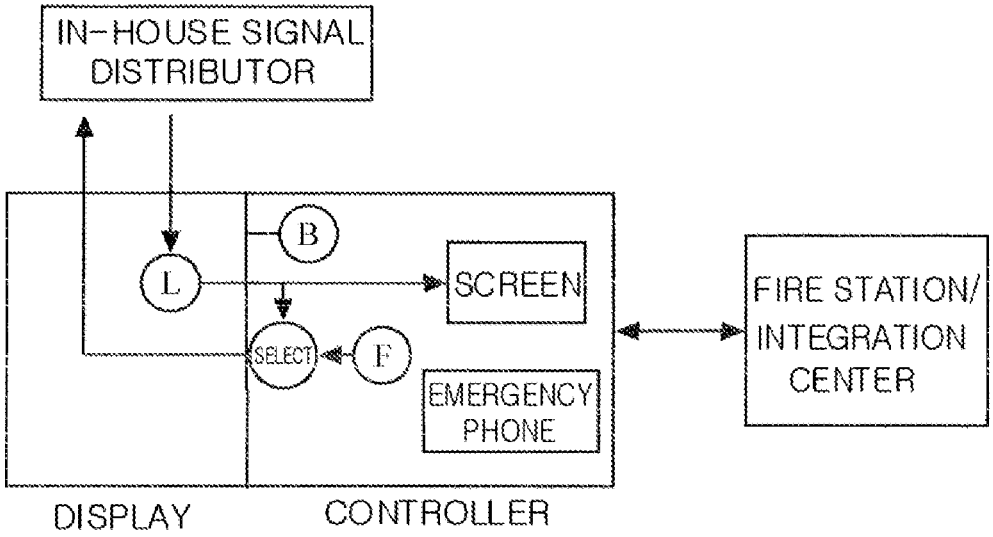
FIG. 3 is a block diagram showing a control panel according to the invention.

FIG. 3 is a block diagram showing a control panel that is located in the disaster preventive center and the apartment administration center, according to the invention. If a fire detector provided in each house is activated to generate a fire detection signal, a house lamp on a display in the control panel is lit, to thereby make a person confirm at which house the fire detection signal is generated. As a result, the house where the fire detection signal has been generated can be immediately confirmed through the house lamp lit by the signal from the signal distributor (and manipulation panel) of each house. Simultaneously, the control panel generates an alarm signal. Then, a person depresses the corresponding house lamp to select the corresponding house, to then confirm whether or not a fire has occurred at the corresponding house through the monitor or the emergency call and to then await a fire extinguishing signal. Moreover, a fire extinguishing process is performed in an external fire station or other integration center, in the same manner as those of the disaster preventive center and the apartment administration center. If the fire extinguishing button is clicked for a predetermined time or longer, it may be designed to be automatically clicked after the predetermined time lapses.

The control panel may have an emergency call function for an emergency call with a desired house. Here, an upper-level control panel binds and manages a number of houses in one premise, and a higher-level control panel than the upper-level control panel binds and manages a number of the upper-level control panels in a number of premises. A fire station is connected with the higher-level control panel so as to be connected with all houses in a corresponding region. Accordingly, the fire station can display a certain house at which a fire has occurred. Further, a corresponding house lamp is selected in the disaster preventive center and the apartment administration center, to thereby make it possible to communicate a signal between the house and the disaster preventive center and the apartment administration center, and/or to make an audio phone call or a video phone call.

The configuration of the control panel is illustrated in the following Table 1.

TABLE 1

| | House | Disaster Preventive Center | Integration Center | Fire Station |
|---|---|---|---|---|
| The number of Accommodated Houses | one house | (50 houses × n) control panels | (2,500 houses × n) control panels | (120,000 houses × n) control panels |
| Select (Split) | | one house (×n) | five disaster preventive centers (×n) | 20 centers (×n) |
| Screen (Split) | | 1 (×n) | 5 (×n) | 20 (×n) |
| Main Screen | | | 1 ( n) | 2 (×n) |
| Emergency Calls | emergency phone | emergency phone | five emergency phones | twenty emergency phones |

Figure 4:
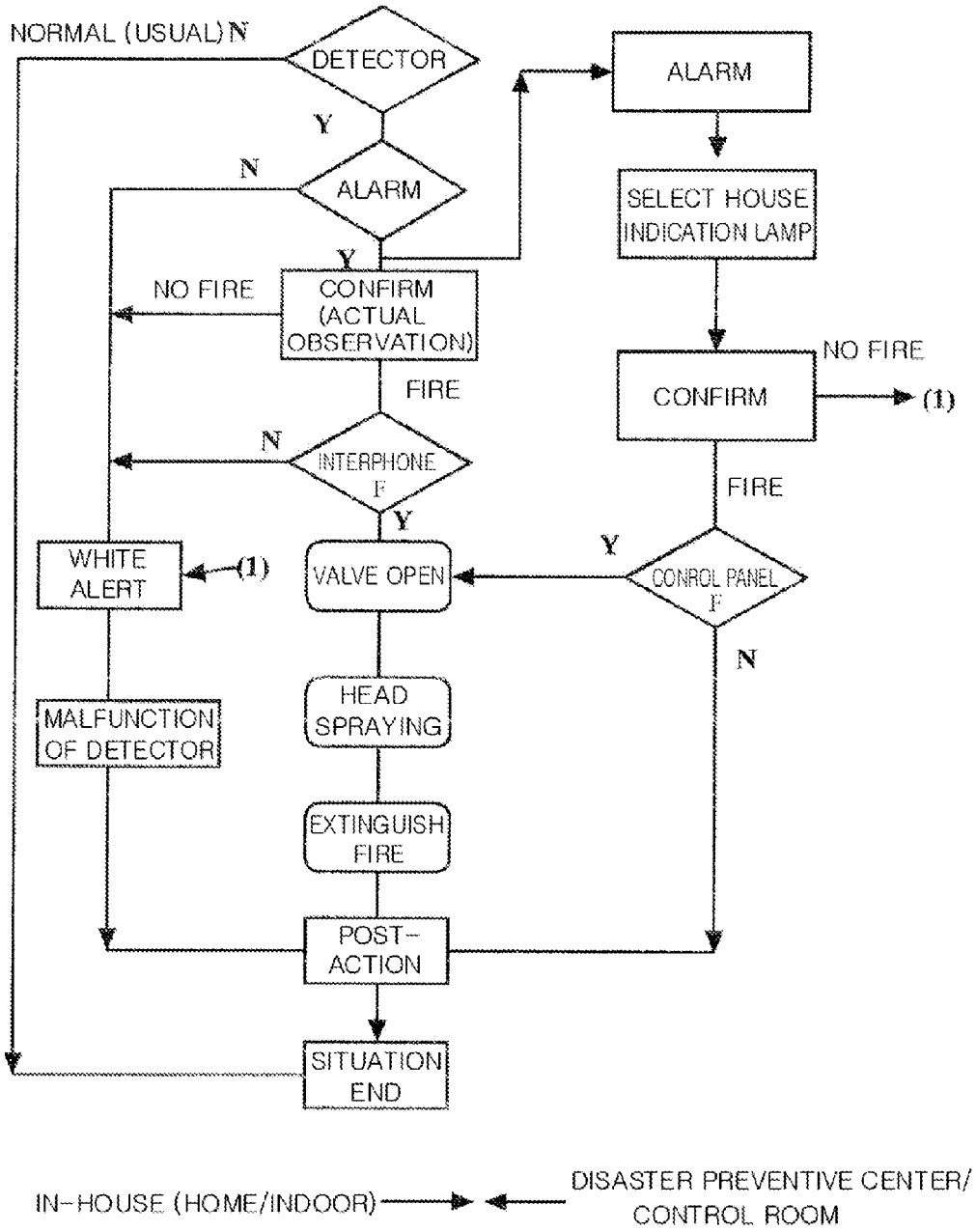
FIG. 4 is a flowchart view showing operations of an early fire extinguishing system in accordance with the present invention.

FIG. 4 is a flowchart view showing operations of an early fire extinguishing system in accordance with the present invention. In FIG. 4, in the case that a fire has been detected by a certain detector in a house, a fire alarm signal is generated in the house, and the fire alarm signal is generated in an external control panel. Thus, if the fire alarm signal is input to the house or the external control panel, a sprinkler valve can be opened.

Figure 5A:
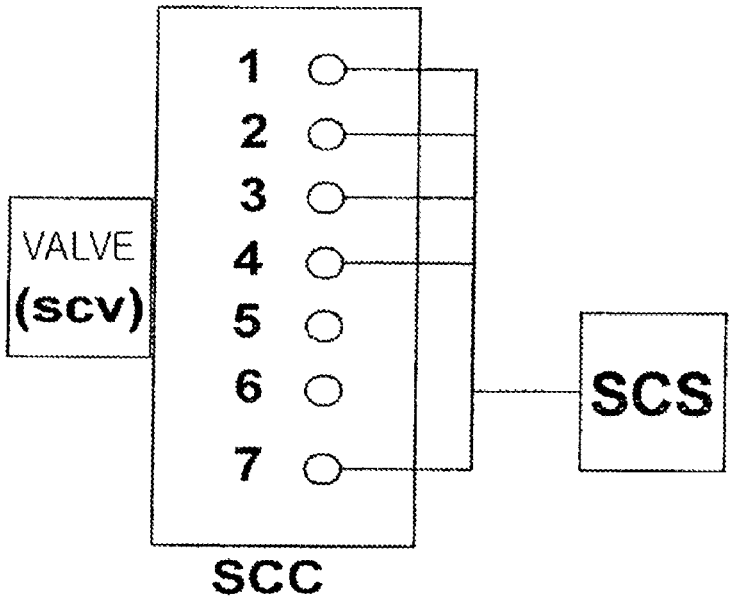
FIGS. 5A, 5B and 5C are diagrams showing examples of a sprinkler controller (SCC) that is used in the present invention.
Figure 5B:
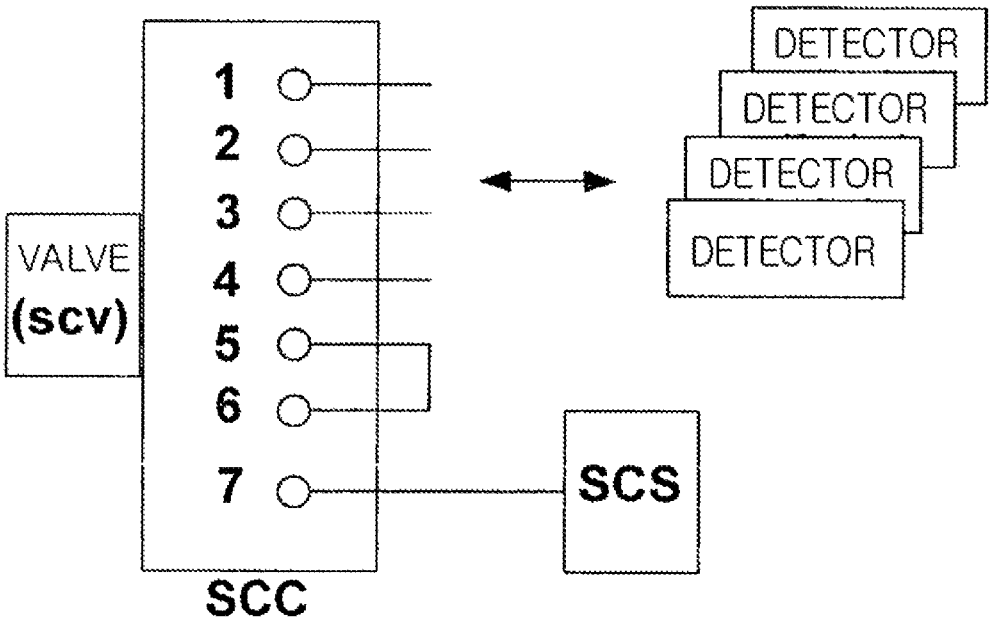
Figure 5C:
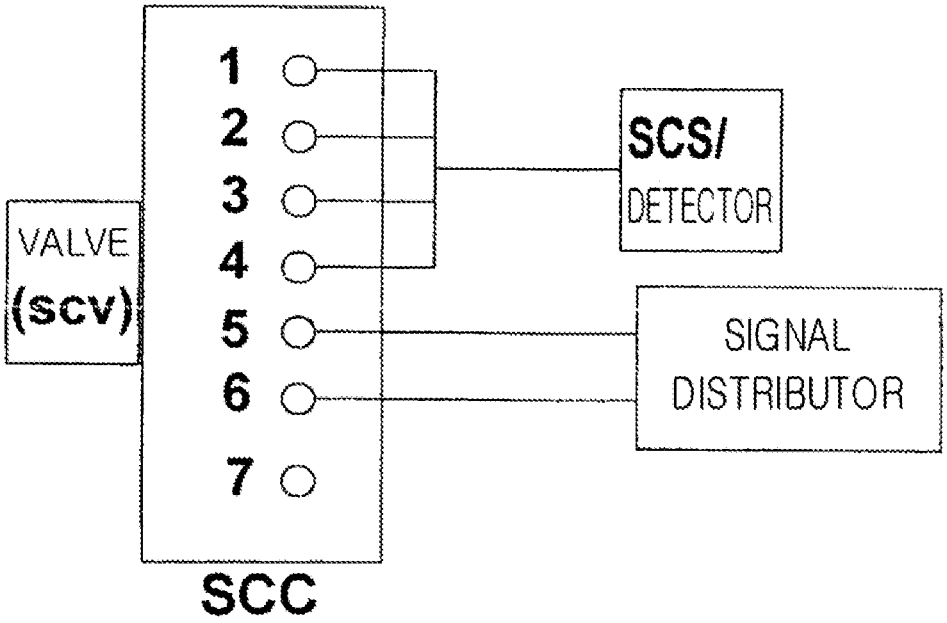

FIGS. 5A, 5B and 5C are diagrams showing examples of a sprinkler controller (SCC) that is used in the present invention, in which wiring diagrams of the sprinkler controller (SCC) are combined to configure the sprinkler controllers (SCC) that are applied for various kinds of environments. As shown in FIG. 1, first through fourth pins are connected to the external detectors. In FIG. 1, a fifth pin is a pin through which an output signal is externally output, a sixth pin is a pin through which a signal is received when an external fire extinguishing button is clicked and a seventh pin is a pin through which a signal is input by a fire detection sensor of the sprinkler controller.

FIG. 5A shows an unmanned system. In the case of the FIG. 5A unmanned system, the fire extinguishing button is not clicked by a person. Accordingly, the fifth and sixth pins are connected with each other or are left unused. Then, the first through fourth pins are connected to the fire detection signals that are input from sprinkler sensors that can detect whether or not a fire occurs. Accordingly, if the fire detection signals are input from the sprinkler sensors, the corresponding input signals are input through the entire first through fourth pins and the seventh pin. Here, a corresponding input signal may be input through the sixth pin. In this case, once a sprinkler according to the present invention is provided at a place where no detector is provided, the sprinkler can be activated.

FIG. 5B also shows an unmanned system. In the case of the FIG. 5B unmanned system, the first through fourth pins are connected to corresponding detectors, respectively, in a region where the detectors are provided. Here, if any one detector is activated, water can be sprayed. Otherwise, water can be sprayed if a signal is input through a seventh pin by a sprinkler sensor (SCS). Since the unmanned system is assumed in FIG. 5B, fifth and sixth pins are interconnected.

FIG. 5C shows a remotely manned system having no person on site. Here, first through fourth pins are connected to sprinkler sensors or detectors. If any fire detection signals are input from the sprinkler sensors or detectors, an external remote control center receives the fire detection signals, checks whether or not a fire has occurred through a monitor and so on, generates a fire extinguishing signal, and controls a corresponding sprinkler to be activated. As described above, the sprinkler according to the present invention receives the fire detection signals detected from not only its own sprinkler sensor but also from the external detectors, to then be activated. Accordingly, the sprinkler sensor and the external detectors may be used in various kind of combination according to different situations. In FIG. 5C, fifth and sixth pins are connected to a signal distributor (and manipulation panel).

The sprinkler and the system using the same in accordance with the present invention may be used for transportation facilities such as train, subways, ships, aircraft, buses that are used by many persons as well as buildings, dangerous facilities, and data processing centers or information processing centers. In other words, since the conventional sprinkler is very sensitive, it may be activated even if there seems a little sign of a fire. Thus, it is difficult to use the conventional sprinkler in the inside of the subway. However, in the case of the present invention sprinkler, since a corresponding sprinkler is activated by operations of the detectors, sprinkler sensors, and fire alarm buzzers, and operations of fire extinguishing buttons that are depressed by persons, there is little or no possibility to cause malfunction. Accordingly, the present invention sprinkler can be activated only according to a necessary situation. In addition, in the case that it is hard for a person directly to confirm whether or not a fire has occurred like places such as common areas or dangerous facilities, it is confirmed whether or not a fire has occurred through a monitor in a main control room or sub-control room. Then, a fire extinguishing button is manipulated to thereby make the sprinkler remotely activated to extinguish the fire. In addition, since it is very easy to use the present invention sprinkler as an unattended operating sprinkler as needed, the present invention sprinkler has an advantage that is can be used as multiple uses in a separate isolated area such as warehouses, workshops, and factories.

Figure 6:
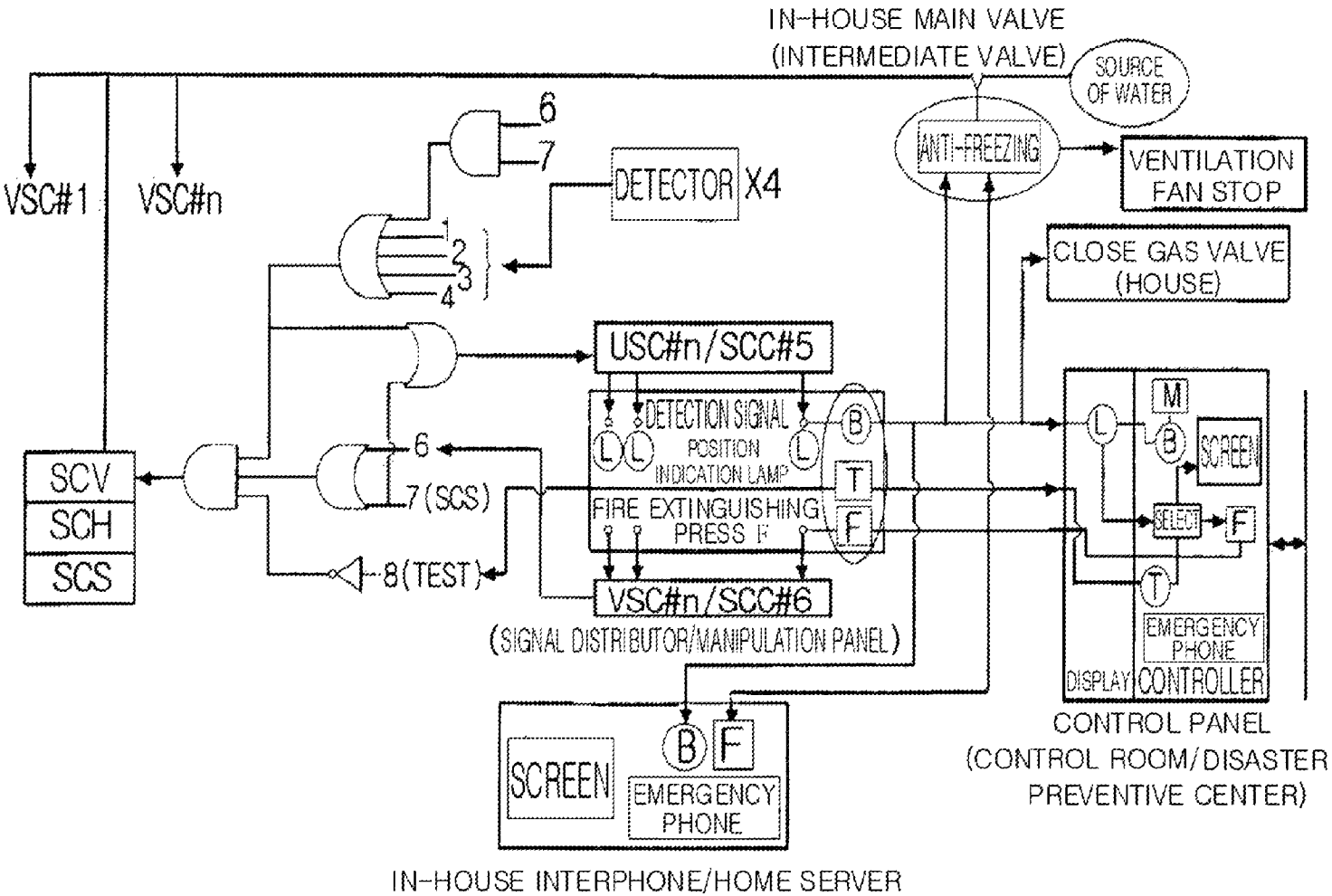
FIGS. 6 and 7 are diagrams showing an early fire extinguishing system employing a valve united sprinkler according to another embodiment of the present invention.

FIG. 6 is a diagram showing an early fire extinguishing system employing a valve united sprinkler according to another embodiment of the present invention. Here, FIG. 6 shows an entire system including a valve united sprinkler, a signal distributor (and manipulation panel) and a control panel. A head shown in FIG. 6 employs a type where a sensor is attached to a valve. In FIG. 6, a sprinkler valve (SCV), a sprinkler head (SCH) and a sprinkler sensor (SCS) are integrally attached to the sprinkler itself. According to a particular specification, the sprinkler sensor (SCS) may not be used.

FIG. 6 shows the in-house system configuration and the control panel that are illustrated in a single drawing. One or more valves may be provided in a house. It is natural that one or more houses may be included in the entire system of FIG. 6.

FIG. 6, first through fourth pins are connected to corresponding detectors, respectively. The number of detectors may vary as required. The number of detectors is limited to four for convenience in the present invention. In FIG. 6, a fifth pin is a pin through which an output signal is externally output, a sixth pin is a pin through which a signal is received when an external fire extinguishing button is clicked, a seventh pin is a pin through which a signal is input by a fire detection sensor of the sprinkler controller, and an eighth pin is a test pin.

As shown in FIG. 6, if any one of the detectors is activated, there is a possibility that a fire may have occurred. Accordingly, one of the first through fourth pins is activated by first through fourth detectors, or its own fire detection sensor is activated. The fire detection signal that is detected by the first through fourth detectors, or its own fire detection sensor, is used as an input signal that is input to a valve controller. In addition, the fire detection signal is output through the fifth pin in order to be sent to a control panel in a control room and so on to thus extinguish the fire. The output signal may be externally output through the fifth pin even in the case that a fire has been detected by the external detector as shown in FIG. 6 as well as in the case that a fire has been detected by its own sprinkler sensor (SCS).

In other words, if its own detection signal that is input by its own detection sensor is input through the seventh pin, the detection signal is directly sent to the external control panel. As described above, in the case that a fire is detected by the detectors and thus a fire extinguishing button is depressed, the sprinkler is activated.

The eighth pin is a test pin for testing whether or not operations of the sprinkler is activated well. If a test signal is input through the test pin, the sprinkler valve does not work, but all of the other own detectors, internal detectors, extinguishing buttons, and the emergency phone communicating with the external control center operate like an actual situation, for testing purpose.

In operation of the in-house signal distributor (and manipulation panel), when any one of the detectors is activated, an "L"-lettered lamp is lit in order to display a place where the detector has detected a fire has occurred. In addition, a bell "B" can be rung. Here, the bell "B" can be rung only in the control room, but can be established so that the bell may not be rung in its senior control center. In addition, while the bell is lit, a gas valve closing signal of the corresponding house is transmitted to thus make incoming gas that is supplied to the corresponding house blocked.

The fire detection signal is directly transmitted to the in-house interphone and so on, and makes the house lamp lit in the apartment control center. In addition, the fire detection signal can make the display lamps lit in the fire station.

If a fire is found at home and thus a fire extinguishing button "F" is depressed, a fire extinguishing signal is input through the sixth pin to make the sprinkler activated to operate.

In the case that a lamp "L" is activated, the emergency phone is activated immediately to enable a call between the control center and the corresponding house. The control center or fire station can grasp whether or not a fire has occurred through a call (or a video phone) communicating with the corresponding house, to thereby make a person depress an "F"-lettered button. Since the "L" lamp turn-on signal is transmitted to the higher level control center as well as the control center, it is possible to make a phone call between the control center and the fire station, and between the corresponding house and the fire station. Further, if the fire extinguishing button "F" is depressed at any one place, a fire extinguishing process is performed.

In addition, if a person in the control center or the fire station depresses the lamp "L" when the lamp "L" is activated, a house in which the fire has occurred is immediately displayed, an emergency call is automatically communicated with the corresponding house, and the "F" button can be pressed immediately, to thus make the sixth pin signal transmitted. In addition, if an output signal is output through the fifth pin in even a house, the bell "B" is lit. In addition, the test signal of the eighth pin is transmitted together in order to notify a person of a testing period. The test signal is transmitted to all of the house, the control center and fire station.

In addition, an anti-freezing house intermediate valve blocks water from going to a sprinkler in order to prepare for anti-freezing. Even if the anti-freezing house intermediate valve is in an anti-freezing mode, a fire extinguishing signal can be always directly to the valve. Thus, when the fire extinguishing signal is input to the valve, the fire can be extinguished immediately. The test signal can be activated in any of the house, the control center and the fire station.

Even after a house where a fire has occurred is particularly selected in the control center or the fire station, a fire extinguishing process is continuously maintained in the lower-level control center or house.

A button "M" of FIG. 6 is a button that changes a current mode into a local mode at which an alarm signal is not transferred to an upper-level control center. In other words, if the button "M" is depressed, the current mode is changed into the local mode at which the alarm signal is not transferred to the upper-level control center such as an integration center. For example, in the case that houses are tested, inspected, and verified or even if a fire has occurred, testing, inspection, and verification of the houses and the fire extinguishing may be processed in the apartment complex.

Figure 7:
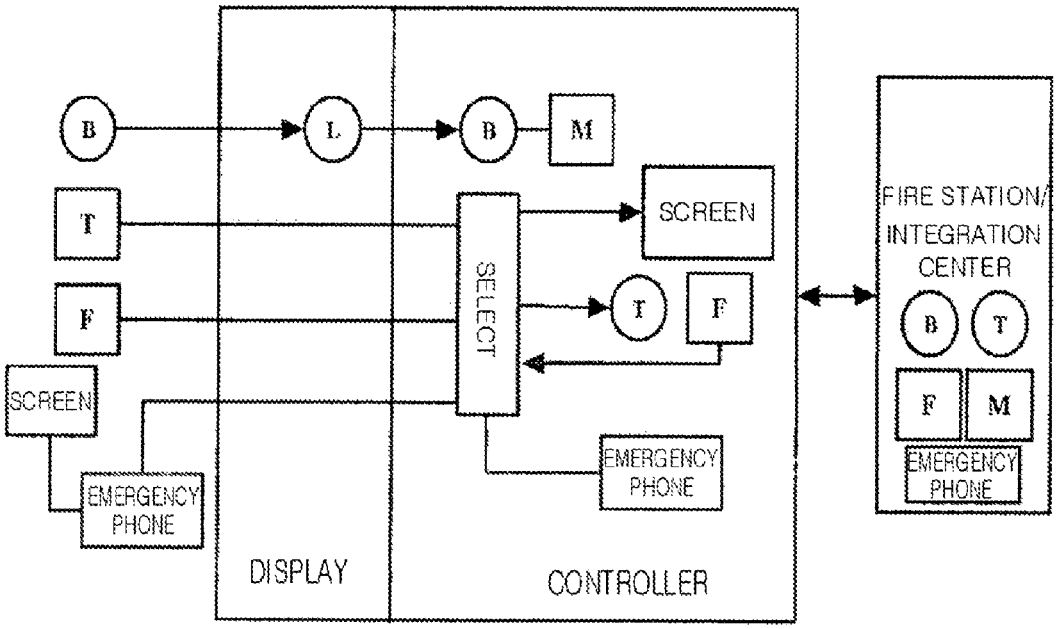

FIG. 7 shows another embodiment of FIG. 3. FIG. 7 is a diagram showing an early fire extinguishing system employing a valve united sprinkler according to another embodiment of the present invention.

Figure 8:
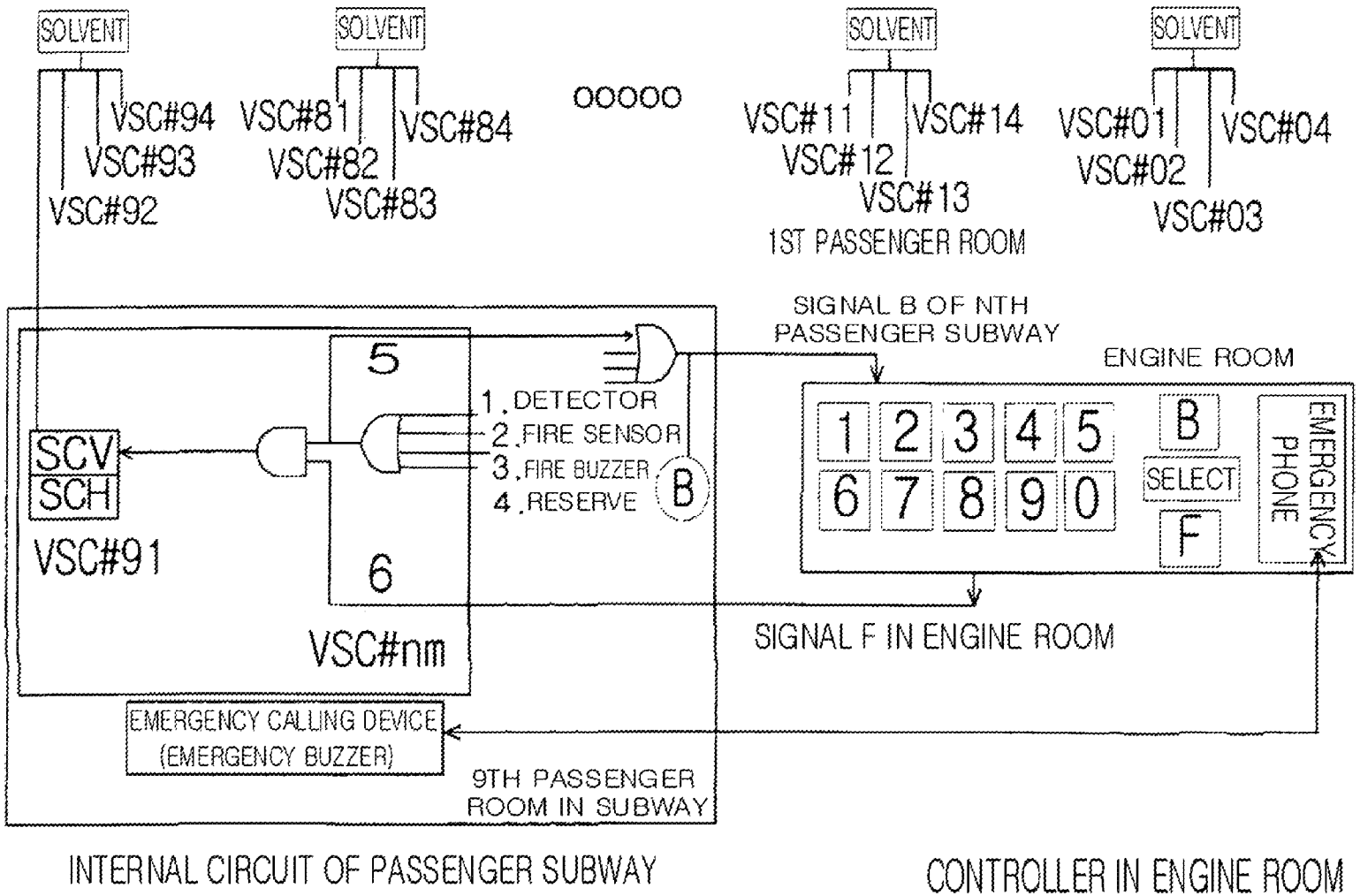
FIG. 8 is a diagram showing an early fire extinguishing system using a valve united sprinkler for use in public transportation facilities, according to the present invention.

FIG. 8 is a diagram showing an early fire extinguishing system using a valve united sprinkler for use in public transportation facilities, according to the present invention. A valve united sprinkler (VSC) for a passenger room and a control panel in an engine room are illustrated in detain in FIG. 8. The valve united sprinkler includes a sprinkler head (SCH), a sprinkler valve (SCV), and a sprinkler controller (SCC). The sprinkler valve (SCV) is an electronic valve and the sprinkler head (SCH) is an open type. Thus, if the sprinkler valve (SCV) is opened by a control circuit of the sprinkler controller (SCC), a solvent such as gas can be immediately sprayed.

The sprinkler controller (SCC) receives a signal sent from a fire detector that is located in the inside of a vehicle such as a train. In the case that fire detection signals are received from one or more fire detectors, fire alarms (B) are made to ring in corresponding passenger rooms and the control panel in an external engine room is notified that a fire has been detected by the fire detectors in the corresponding passenger rooms. Simultaneously, a fire alarm (B) is made to ring in the control panel of the engine room, and a lamp in the corresponding passenger room is made to be turned on so as to see at which passenger room a fire has occurred.

In the engine room, it may be confirmed whether or not an actual fire has occurred using an emergency phone, in order to check at which passenger room a fire has occurred. Then, a fire extinguishing button (F) is depressed to make the sprinkler valve (SCV) being the electronic valve opened so that a solvent can be sprayed to extinguish the fire.

In addition, it may be confirmed whether or not a fire has occurred using an emergency call device or an emergency buzzer as well as the emergency phone. A surveillance camera such as a closed circuit television (CCTV) in a passenger room, in order to monitor the passenger room. Then, the fire extinguishing button (F) is depressed to extinguish the fire. Here, the entire sprinklers in the corresponding passenger room can be simultaneously opened. Otherwise, only a sprinkler that is connected to a fire detector having detected the fire may be activated.

Six pins are illustrated as input/output (I/O) pins for a fire detector in FIG. 8, but is not limited thereto. First and second pins are connected to a fire detector or fire detection sensor in a passenger room of a vehicle, to monitor whether or not a fire has occurred in the passenger room. In addition, a third pin is connected to a fire buzzer. Accordingly, even if a fire has not been detected by a fire detector, a passenger can find the fire before the fire detector, to then depress the fire buzzer. In the engine room, it may be confirmed whether or not a fire has occurred using an emergency call device or a closed circuit television (CCTV). A fourth pin is a reserve pin that can be connected to a separate fire detector or buzzer.

In addition, the first through fourth pins are connected to an OR gate. Thus, if the fire detection signal is input from any one of the fire detector, the fire detection sensor, or the fire buzzer, a fire alarm in the engine room is made to ring. A signal that makes the bell ring in the engine room is output via a fifth pin of the sprinkler. The fifth pin output signal is OR-operated with a fifth pin signal that is transmitted from another sprinkler in the corresponding passenger room. Thus, if one of the fifth pin signals is detected, the OR-operation result is sent to the engine room control panel.

The sixth pin is connected to the fire extinguishing button (F) that a person depresses in order to extinguish a fire after having confirmed occurrence of the fire in the engine room. Thus, if a fire extinguishing button (F) for a corresponding passenger room is depressed, a fire extinguishing button click signal is input to the sprinkler via the sixth pin.

Only in the case that the fire extinguishing button is depressed in the engine room while either the fire detector or the fire buzzer is depressed, the sprinkler valve (SCV) is activated to extinguish the fire. To do so, the signal input via the sixth pin and the OR-operation value of the signals input via the first through fourth pins are AND-operated in an AND gate to then be input to the sprinkler valve (SCV).

In FIG. 8, it is assumed that four sprinklers are provided in each passenger room, and a fire extinguishing solvent is separately stored in each passenger room. When it is detected that a fire has occurred in a passenger room, the bell rings in the engine room. Here, it is grasped at which passenger room the bell rings and from which passenger vehicle the fire detection signal is transmitted, to then perform a necessary fire extinguishing process. The engine room 0 and the passenger rooms 1 through 9 are shown in FIG. 8.

Figure 9:
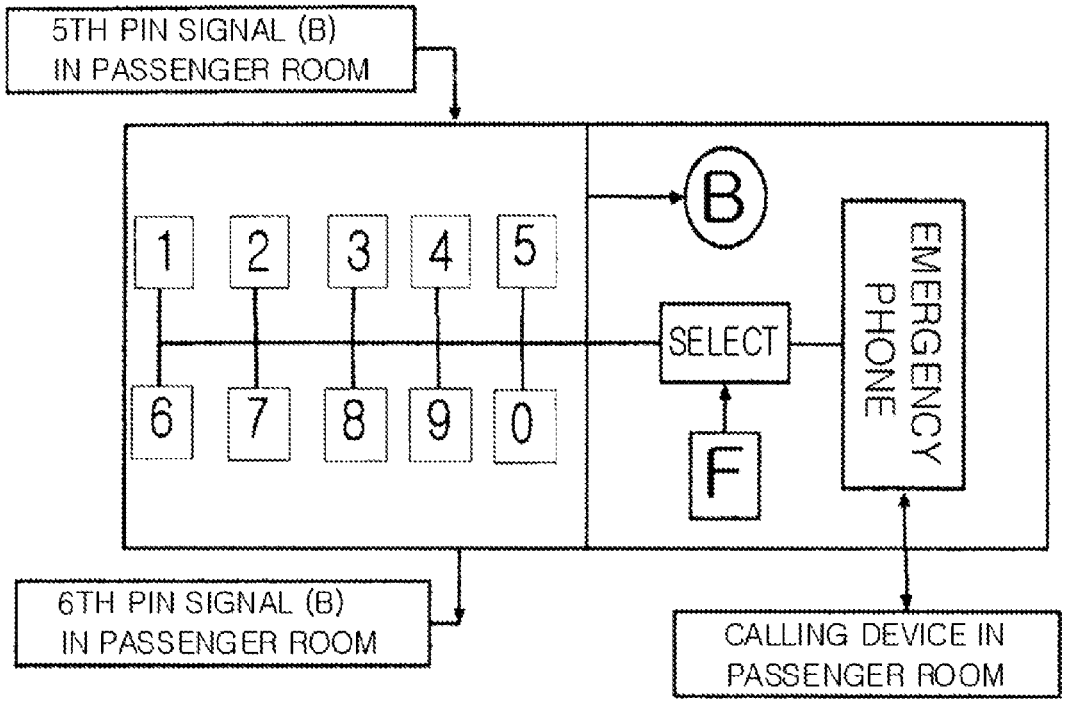
FIG. 9 is a diagram showing a control panel according to the present invention.

FIG. 9 is a diagram showing a control panel that is located in an engine room according to the present invention. The control panel is numbered. Accordingly, it can be confirmed from which passenger room a fire detection signal has been generated. As a result, it can be immediately confirmed from which passenger room a fire detection signal is generated by the fire detection signal that is transmitted from each vehicle, with signal lamps that are lit. Simultaneously, if a fire alarm signal is generated, a corresponding passenger room number button is depressed to confirm whether or not a fire has occurred through an emergency phone, an in-house calling device, or a closed circuit television (CCTV) that communicates with the corresponding passenger room where the fire has occurred, to then extinguish the fire. In addition, if no fire extinguishing button is depressed for a predetermined time or more since an administrator is absent, or if a plurality of the fire detectors or the fire buzzers are activated, the fire extinguishing button may be automatically clicked after a certain period of time. In the case of moving vehicles such as buses, the fire detectors may be connected with an external control panel that confirms the status of the vehicles via a wireless network. In the case that any of the fire detectors has detected a fire has occurred in a vehicle, a fire alarm signal is generated in the vehicle, as well as in the engine room or the external control panel that manages the vehicle. If a person who has confirmed the fire had occurred depresses the fire extinguishing button (F) to thus make the sprinkler valve (SCV) opened to extinguish the fire.

Figure 10:
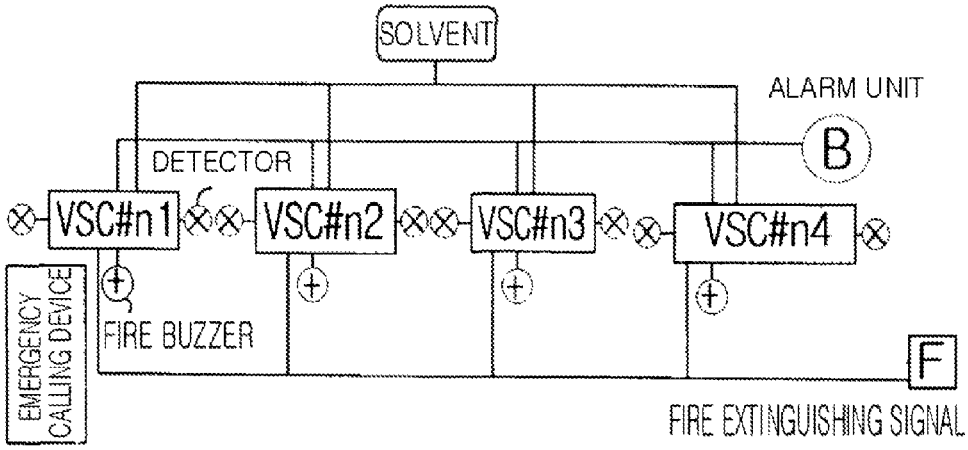
FIG. 10 is a diagram showing a layout of sprinklers and detectors according to the invention.

FIG. 10 is a diagram showing a layout of valve united sprinklers (VSCs), fire detectors and fire buzzers in a passenger vehicle. The number of sprinklers that are provided in one vehicle or passenger room. In FIG. 10, four valve united sprinklers are illustrated. The fire detectors may be located at required places. The fire buzzers may be placed at required positions that can be accessed by hand, in order to transmit a fire alarm signal and a fire detection signal to the engine room at fire. In addition, a person can communicate with the engine room or the external control panel that manages the passenger vehicle via an emergency calling device in the passenger vehicle.

Figure 11:
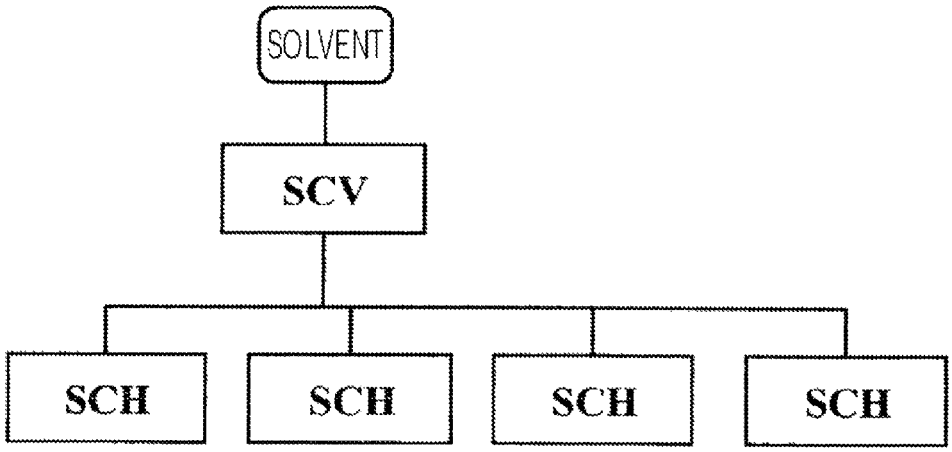
FIGS. 11, 12 and 13 are diagrams showing examples of spraying water in an early fire extinguishing system in accordance with the present invention.

FIG. 11 is a diagram showing an example of spraying water in an early fire extinguishing system in accordance with the present invention. In the above-described embodiment, a sprinkler valve is provided in a sprinkler in order to make only a sprinkler corresponding to a fire detector having detected a fire perform a water spraying operation. However, referring to FIG. 11, since a rapid fire-fighting operation is essential on fire of main buildings or vehicles, an electronic valve is provided at only one place close to a fire extinguishing solvent, to thereby make all sprinklers spray the solvent if the fire extinguishing button.

Figure 12:
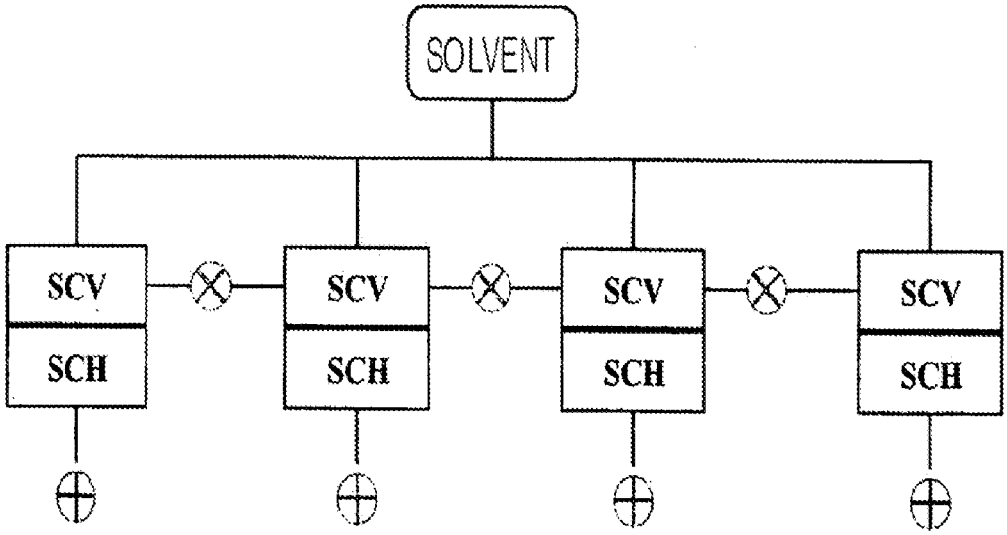

FIG. 12 is a diagram showing another example of spraying water in an early fire extinguishing system in accordance with the present invention. All the sprinklers perform spraying simultaneously in FIG. 11. However, in FIG. 12, a sprinkler valve is provided in a sprinkler and then a fire detector is shared between adjoining sprinklers. Here, in the case that it is detected by a single fire detector that a fire has occurred, a spraying range can expand so that the adjacent sprinklers can perform a spraying operation all at a time. Otherwise, the early fire extinguishing system is designed so that the sprinklers that are not adjacent to each other are not activated, to thereby limit a spraying range.

Figure 13:
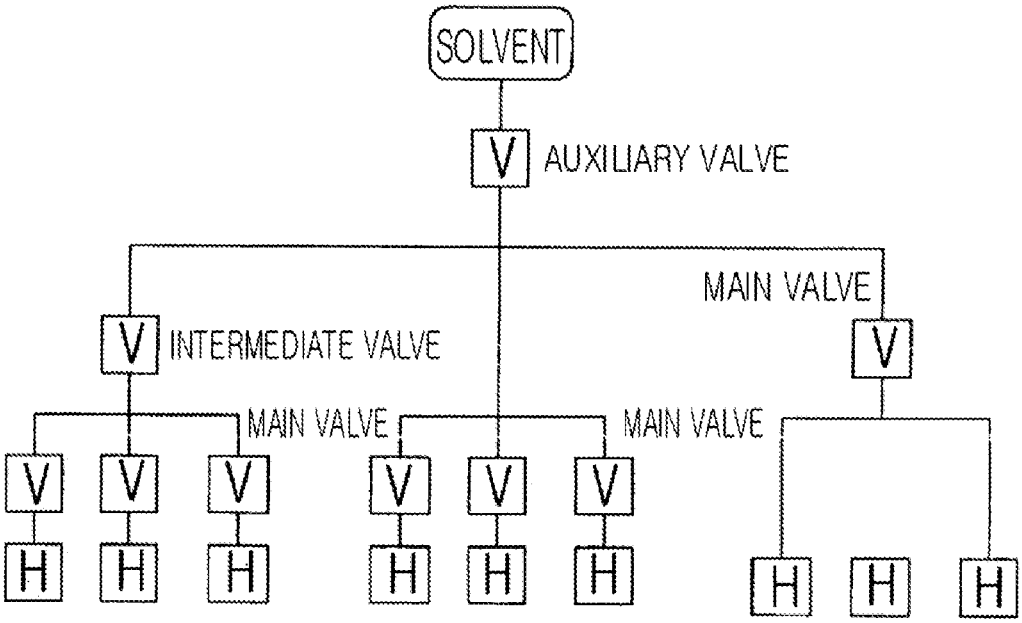

FIG. 13 is a diagram showing still another example of spraying water in an early fire extinguishing system in accordance with the present invention. In FIG. 13, sprinkler valves are grouped in a branch style in facilities or buildings that need to adjust or expand a spraying range. In other words, the sprinkler valves are divided into main valves and auxiliary valves, in which the main valves are provided near the sprinklers, respectively, and the auxiliary valves are provided near the solvent. Accordingly, the sprinklers are activated only in the corresponding place as necessary. For example, if only part of the fire detectors are activated, only the adjacent sprinklers are made to open. However, in the case that there is a request of a passenger who has depressed a fire buzzer in a passenger vehicle, the entire sprinkler valves may be made to open.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

As described above, the present invention can be applied in a fire-fighting system.

The invention claimed is:

1. A valve united sprinkler comprising:

an open sprinkler head that is connected to a fire extinguishing solvent storage to sprinkle the solvent;

a sprinkler valve that is located between the solvent storage and the sprinkler head to open up the sprinkler head;

a sprinkler sensor that is located near the sprinkler head to detect a fire; and a sprinkler controller that controls only the sprinkler valve and makes the sprinkler valve operate, wherein the sprinkler controller comprises:

a plurality of external detector signal input pins that are communicatively connected to a plurality of external detectors that are not part of the sprinkler but are located near the sprinkler to detect a fire, in order to receive fire detection signals from the external detectors;

a fire alarm signal output pin through which to output a fire alarm signal generated from the fire detection signals generated from the fire detection signals to a control panel;

a fire extinguishing signal input pin through which to receive a fire extinguishing signal generated by the control panel in response to depression of a fire extinguishing button of the control panel after a fire has been recognized by an operator that presses the fire extinguishing button; and a sprinkler sensor signal input pin through which to receive a sprinkler sensor signal from the sprinkler sensor that is attached to the sprinkler and detects a fire, wherein the sprinkler controller activates the sprinkler valve in response to determining that (i) at least one of the fire detection signals generated by the external detectors indicates a fire is detected and (ii) the fire extinguishing signal indicates a fire has been recognized or the sprinkler sensor signal indicates a fire is detected, wherein the sprinkler controller generates the fire alarm signal indicating that a fire is detected in response to determining that (i) at least one of the fire detection signals generated by the external detectors indicates a fire is detected or (ii) the sprinkler sensor signal indicates a fire is detected.

2. The valve united sprinkler according to claim 1, wherein the sprinkler controller activates the sprinkler valve in response to determining that (i) the fire extinguishing signal indicates a fire has been recognized and (ii) the sprinkler sensor indicates that a fire is detected.

3. The valve united sprinkler according to claim 1, wherein the sprinkler controller prevents the sprinkler valve from being activated in response to determining that a test signal indicates that the valve united sprinkler is being tested.

4. An early fire extinguishing system using a valve united sprinkler, the early fire extinguishing system comprising:

a plurality of external detectors that are not part of any valve united sprinkler but are located near the sprinkler to detect a fire;

a plurality of valve united sprinklers each comprising:

a plurality of external detector signal pins that are connected to the external detectors to receive fire detection signals from the external detectors;

a fire alarm signal output pin through which to output a fire alarm signal generated from the fire detection signals to a control panel;

a fire extinguishing signal input pin through which to receive fire extinguishing signal generated by the control panel in response to depression of a fire extinguishing button of the control panel after a fire has been recognized by an operator that presses the fire extinguishing button; and a sprinkler sensor signal input pin through which to receive a sprinkler sensor signal from the sprinkler sensor that is attached to the sprinkler;

a signal distributor to receive the fire alarm signals from the valve united sprinklers and to transmit the fire alarm signals to the control panel; and the control panel to receive the fire alarm signals from the signal distributor, the control panel comprising:

a controller that includes a fire alarm unit that alarms an occurrence of the fire as sound, a display that displays a location of a fire, a fire extinguishing signal input unit that generates the fire extinguishing signal; and a stop signal input unit that sends the fire extinguishing signal to an anti-freezing intermediate valve and a ventilation fan, both of which are activated by the fire extinguishing signal;

wherein the sprinkler controller activates the sprinkler valve in response to determining that (i) at least one of the fire detection signals generated by the external detectors indicates a fire is detected and (ii) the fire extinguishing signal indicates a fire has been recognized or the sprinkler sensor signal indicates a fire is detected, wherein the sprinkler controller generates the fire alarm signal indicating that a fire is detected in response to determining that (i) at least one of the fire detection signals generated by the external detectors indicates a fire is detected or (ii) the sprinkler sensor signal indicates a fire is detected.

5. The early fire extinguishing system of claim 4, wherein the signal distributor transmits a signal that activates an indoor gas circuit breaker when the signal distributor receives one or more fire alarm signals.

6. The early fire extinguishing system of claim 4, further comprising an emergency telephone network that operates during occurrence of a fire and connects a house where a fire broke out and a senior management agency.

7. A valve united sprinkler comprising:

an open sprinkler head that is connected to a fire extinguishing solvent storage to sprinkle the solvent;

a sprinkler valve that is located between the solvent storage and the sprinkler head to open up the sprinkler head;

a sprinkler sensor that is attached to the sprinkler to detect a fire; and a sprinkler controller that makes the sprinkler valve operate;

wherein the sprinkler controller comprises:

one or more external detector signal pins that are connected to one or more external detectors which are not attached to the sprinkler but are located near the sprinkler, respectively to detect a fire;

a fire alarm signal output pin through which a fire alarm signal is output to a control panel through a signal distributor and in which the fire alarm signal is generated from one or more fire detection signals generated from the one or more detectors;

a fire extinguishing signal input pin through which a fire extinguishing signal is input in which the fire extinguishing signal is generated by pressing a fire extinguishing button at the control panel according to the fire alarm signal; and a sprinkler sensor signal input pin through which the sprinkler sensor signal from the sprinkler sensor is input in which the sprinkler sensor is attached to the sprinkler to detect a fire, wherein the values of the one or more fire detection signals generated from the one or more external detectors are OR-operated to thus output the fire alarm signal in the case that the one or more external detectors have been operated, and an OR-operation value of the one or more fire detection signals generated from the one or more external detectors and a value of the sprinkler sensor signal are OR-operated, to thus be an output value to the control panel for the generation of the fire alarm signal, wherein the OR-operation value of the one or more fire detection signals generated from the one or more external detectors and an OR-operation value of the fire extinguishing signal and the value of the sprinkler sensor signal are AND-operated, to thus activate the sprinkler valve.

8. The valve united sprinkler of claim 7, wherein the input value of a finally operated AND-operation value comprises a test signal in which the test signal is always NOT-operated to then be input, with a result that the finally operated AND-operation value becomes fault (F) to make the valve not activated.

* * * * *